United States Patent [19]

Toscano

[11] 4,267,701

[45] May 19, 1981

[54] HELIUM LIQUEFACTION PLANT

[75] Inventor: William M. Toscano, Sudbury, Mass.

[73] Assignee: Helix Technology Corporation, Waltham, Mass.

[21] Appl. No.: 92,232

[22] Filed: Nov. 9, 1979

[51] Int. Cl.[3] ..... F25B 9/00

[52] U.S. Cl. ..... 62/86; 62/9; 62/402; 62/514 R

[58] Field of Search ..... 62/514 R, 9, 22, 38, 62/86, 402

[56] References Cited

U.S. PATENT DOCUMENTS

| | | | |
|---|---|---|---|
| 2,458,894 | 1/1949 | Collins | 62/178 |
| 3,199,304 | 8/1965 | Zeitz et al. | 62/79 |
| 3,360,955 | 1/1968 | Witter | 62/335 |
| 3,375,675 | 4/1968 | Trepp et al. | 62/45 |
| 3,415,077 | 12/1968 | Collins | 62/467 |
| 3,438,220 | 4/1969 | Collins | 62/6 |
| 3,611,740 | 10/1971 | Giger | 62/79 |
| 3,613,387 | 10/1971 | Collins | 62/100 |
| 3,864,926 | 2/1975 | Collins | 62/9 |
| 3,878,691 | 4/1975 | Aszoltos | 62/514 R |
| 4,048,814 | 9/1977 | Quack | 62/514 R |
| 4,161,107 | 7/1979 | Korsakov-Bogatkov et al. | 62/39 |

OTHER PUBLICATIONS

Toscano, W. M. et al.: Thermodynamic and Mechanical Design of the Final Central Helium Liquifier, Cryogenic Engr. Conference, 8, 2,-8, 5, 1977, Boulder, Colo.

Hubbell, Richard H.: A 1400 l/hr. Helium Liquification Cycle-Helix Corp.

*Primary Examiner*—Ronald C. Capossela

*Attorney, Agent, or Firm*—Hamilton, Brook, Smith & Reynolds

[57] ABSTRACT

In a helium liquefaction plant, a compressor includes first, second and third stages and a precooling section includes first, second and third turboexpanders in series between high and low pressure lines of a heat exchanger. A portion of the medium pressure gas at the output of the second turboexpander is directed back through the heat exchanger and mixed with the output of the first compressor stage. The third turboexpander is positioned between the medium and low pressure lines.

10 Claims, 2 Drawing Figures

HELIUM LIQUEFACTION PLANT

Description

1. Technical Field

This invention relates to a method and apparatus for liquifying helium in a refrigeration system.

2. Background Art

Although there are several known cycles for liquifying helium and a number of apparatus capable of performing these cycles, the most widely used cycle and apparatus are those embodied in the Collins helium cryostat described in U.S. Pat. No. 2,458,894. In the basic Collins liquefaction cycle a stream of high pressure helium gas is precooled by indirect heat exchange with a counterflowing stream of cold low pressure helium gas. After the high pressure gas is cooled to below the inversion temperature of the helium, liquefaction is accomplished by one or more expansions through one or more Joule-Thomson (J/T) valves. In U.S. Pat. 3,864,926, the J/T valves are replaced by a liquifying expansion engine. In either case, the expanded and thus cooled gas becomes a mixture of liquid and gas. The liquid is collected and the gas is returned in the low pressure stream.

The low pressure stream of gas in the precooling heat exchanger is provided both by the liquifying expansion element, either a J/T valve or a wet expander, and by additional work extracting expanders. The gas which is cooled in the work extracting expanders is withdrawn from the high pressure stream at appropriate temperature levels for near isentropic expansion.

Helium gas precooled in the heat exchanger associated with the work extracting expanders is passed through a final heat exchanger before it enters the liquifying expansion element. For the case of a J/T valve, the temperature of the high pressure gas entering that final heat exchanger must be below the inversion temperature, approximately 30 K. for helium. Even where a liquifying expansion engine is used, some precooling is necessary. With either liquifying element, the percentage of liquid in the expanded liquid/gas mixture can be increased by reducing the temperature of the gas entering the final heat exchanger.

The thermodynamic efficiency of the precooling heat exchanger can be maximized by minimizing the temperature pinch in the exchanger, that is the temperature difference between high and low pressure lines. Ideally, the temperature pinch at the final exchanger temperature level can be minimized by increasing the number of work extracting expanders. An increased number of such cooling stages also reduces the sensitivity of the thermodynamic efficiency to off-design performance conditions such as reduced liquifaction rates. However, increasing the number of work extracting expanders beyond three or four does not add sufficiently to the thermodynamic efficiency of the system to make the additional expanders cost effective. It is thus important that the thermodynamic efficiency of a system using only a given number of expanders be maximized by the arrangement of the expanders, heat exchangers and compressors in the system.

An object of this invention is to provide a helium liquefaction plant which makes most efficient use of a limited number of work extracting expanders and which provides a thermodynamic performance of up to about 25 percent of Carnot efficiency.

Most work extracting expanders are either reciprocating expansion engines or turbines. Turbines are known to be more reliable than the expansion engines because the latter are susceptible to performance deterioration due to contamination. Expansion turbines are thus preferred in the precooling section. Turbines do suffer from the disadvantage of having a limited expansion ratio, that is a limited ratio of inlet to outlet pressures. On the other hand, a high pressure ratio between the high pressure helium gas and the low pressure helium gas is desired. Specifically, a pressure ratio in the order of 18 to 1 is optimum. A further object of this invention is to provide a liquefaction plant which permits the use of a limited number of turboexpanders in an optimum pressure ratio system.

The power input to a liquefaction system is applied to the helium compressors which deliver high pressure helium gas to the high pressure line. A further object of this invention is to provide high isentropic efficiency compressor stages of acceptable size.

SUMMARY OF THE INVENTION

In a helium liquefaction plant, gas in a high pressure line from a compressor section is precooled by gas in medium and low pressure lines and is liquified in a liquifying stage. Some of the high pressure gas is expanded and returned to the compressor section through the medium pressure line and gas from the liquifying stage is returned through the low pressure line. In accordance with the invention, an expander is positioned between the medium and low pressure lines for further cooling of a portion of the medium pressure gas.

In accordance with a preferred form of the invention, two turboexpanders separated by a heat exchanger are placed in series between the high pressure and medium pressure lines and a third turboexpander is positioned between the medium and low pressure lines. Three compressor stages are provided with low pressure gas applied to the first stage. The first stage output and medium pressure gas is applied to the second stage. By minimizing the difference in power input into the compressor stages, the isentropic efficiency of the compressor section is maximized. The arrangement of turboexpanders, compressors and heat exchangers allows for this high compressor isentropic efficiency while also permitting a proper choice of pressure ratios for the turboexpanders.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

PREFERRED MODE OF CARRYING OUT THE INVENTION

Figure 1:
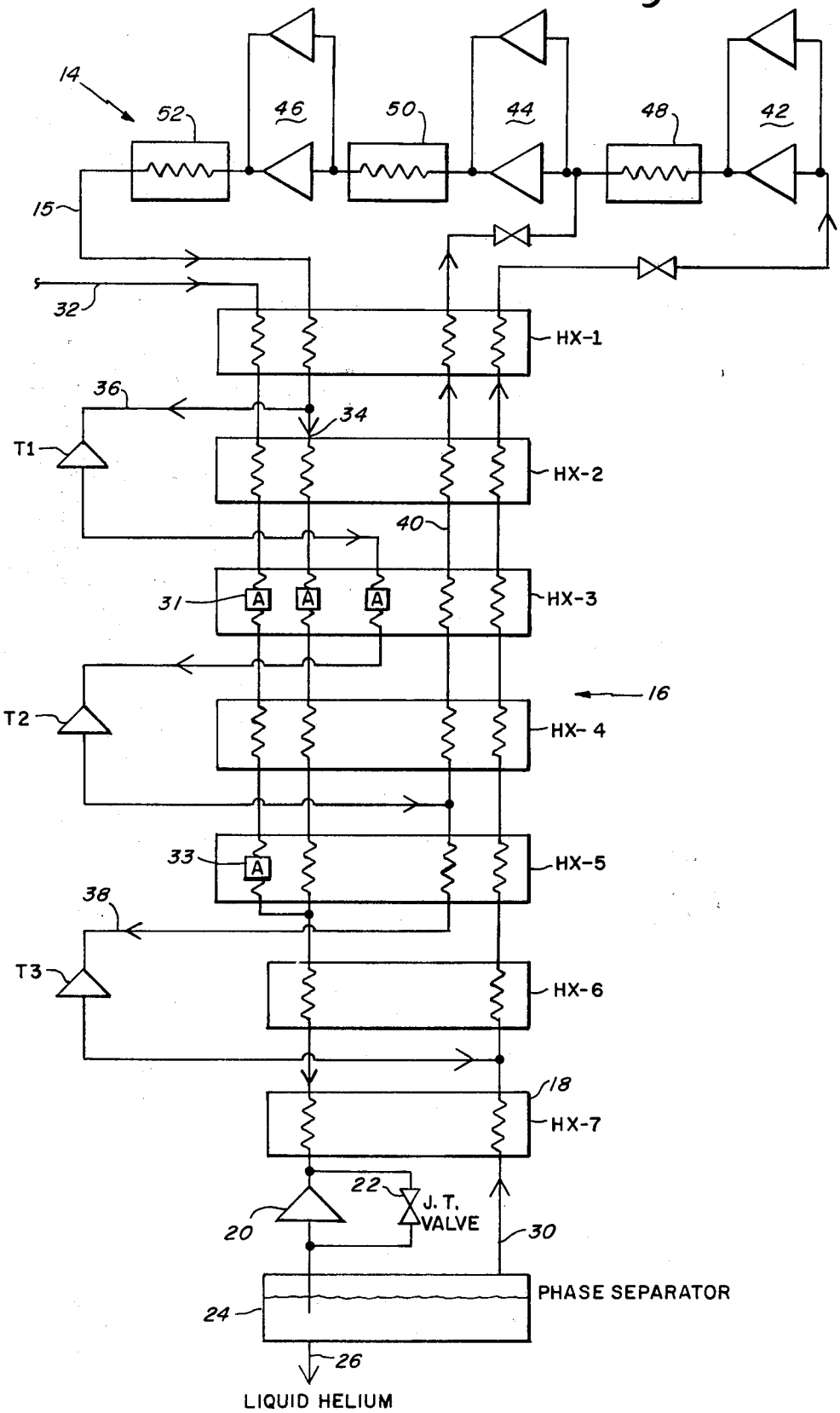
FIG. 1 is a schematic diagram of the compressor, heat exchangers and expanders in a liquefaction plant embodying the present invention.

A helium liquefaction plant is shown in FIG. 1. In the plant, helium gas is compressed in a compressor section 14. The gas then passes through high pressure lines 15 and 34 of a precooling heat exchanger 16. Precooled gas is further cooled in a final heat exchanger 18 before it is expanded in a wet engine 20 or a Joule-Thomson valve 22. The wet engine is the primary liquefaction element in this system because of its high isentropic efficiency. The less expensive J/T valve 22 is provided as a backup element for continued operation of the system when the wet engine 20 is under repair. The final heat exchanger 18 positioned below all precooling expanders is referred to as a J/T heat exchanger even where the final liquifying expansion is not by a J/T valve.

With expansion of the cooled, high pressure helium gas in the wet expander 20, the gas changes to a mixture of liquid and gas. The mixture is fed into a tank 24 where the liquid is collected. The liquid helium may then be used to refrigerate a load, or it may be taken off through a line 26 to a separate storage tank or the like. The gas of the liquid/gas helium mixture is drawn through the low pressure line 30 back through the J/T exchanger 18 and the precooling exchanger 16 to the compressor 14. The gas is then compressed once again to the high pressure. Makeup gas is added.

High pressure makeup gas is added by line 32. Before the makeup gas is mixed with the gas in high pressure line 34 it is cooled and purified. Impurities are removed by adsorbers 31 and 33.

As in other liquefaction systems, energy is first imparted to the helium gas in the compressor section 14. Some of that high pressure gas is directed to expanders which extract energy from the gas and thus cool it. The remainder of the high pressure gas is directed through the heat exchanger 16 until it is sufficiently precooled for expansion into a liquid/gas mixture.

The exchanger 16 is a counterflow exchanger with the low pressure gas in line 30 and the medium pressure gas in line 40 cooling the high pressure gas in lines 15 and 34. Additional lines at intermediate pressures extends through certain portions of the heat exchanger sections as will be discussed below. For convenience in describing operation of the system, the precooling heat exchanger 16 is shown as comprising six separate sections. In practice, the exchanger 16 may comprise more or fewer heat exchanger units. The heat exchanger sections are brazed aluminum platefin heat exchangers. They are fitted vertically within a cold box with the cold ends down so that any natural convection effects are in the proper direction.

Figure 2:
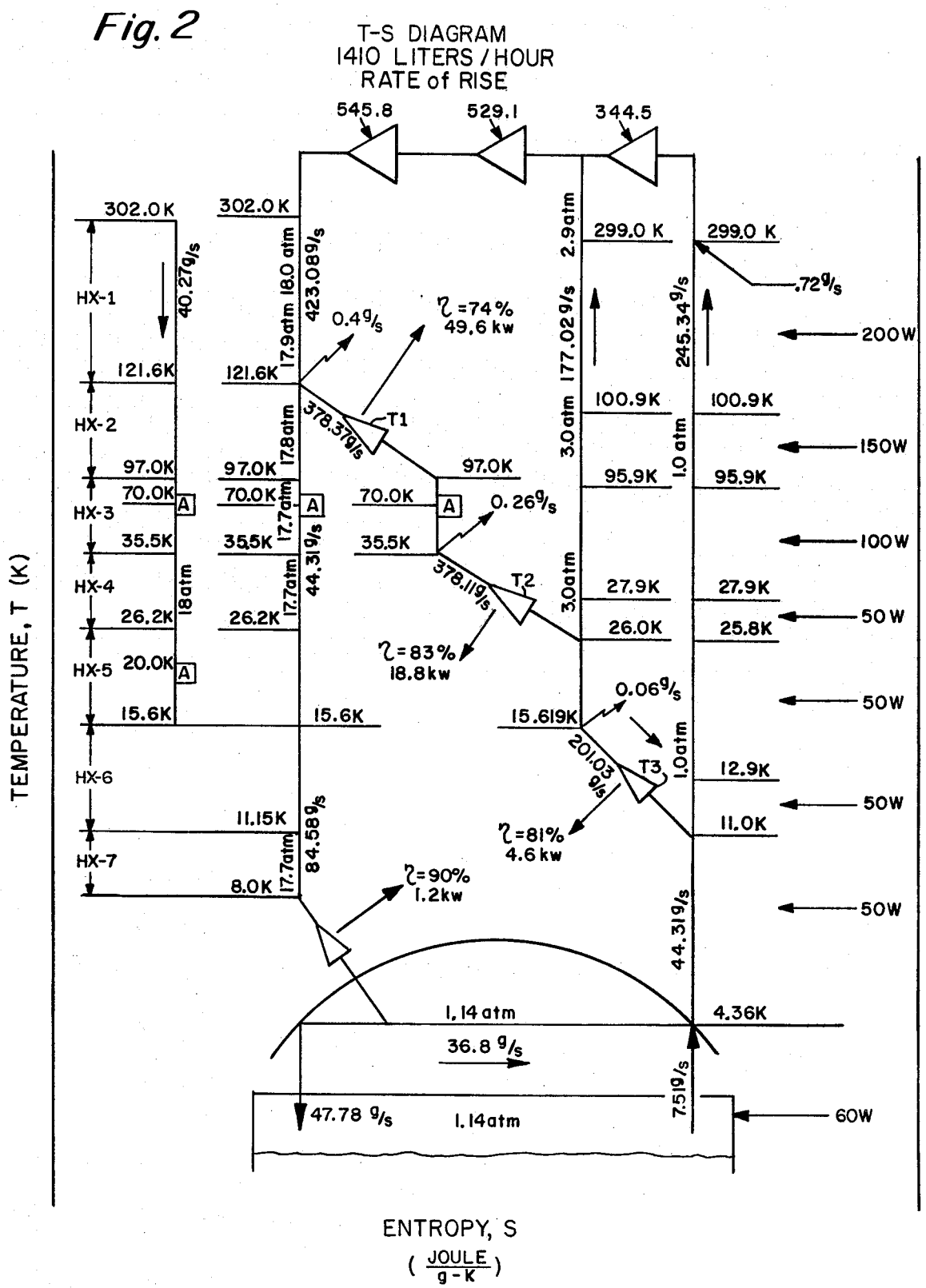
FIG. 2 is a temperature/entropy diagram of the system of FIG. 1.

As indicated in the temperature entropy diagram of FIG. 2, once the high pressure gas in line 15 is cooled to 121.64 K. in the heat exchange section HX-1, it is divided into a first high pressure stream 34 and a second stream 36. The gas in line 34 continues through the remaining heat exchange sections to the wet expander 20. The gas in line 36 is expanded in a turboexpander T1 and is thus cooled to 97 K. That gas is then passed through exchanger section HX-3 where it is further cooled to 35.52 K. The gas is then further expanded in a medium pressure turboexpander T2 to 26K. and three atmospheres pressure.

A portion of the three atmosphere medium pressure gas is directed through heat exchanger HX-5 and line 38 to a third turboexpander T3. Turboexpander T3 expands and cools that portion of the medium pressure gas to one atmosphere and 11 K. The gas is directed to low pressure return line 30 which carries the low pressure gas back through the precooling exchanger 16 to the compressor 14.

Each of the turbines T1, T2 and T3 is an oil bearing turbine. The particular wet engine used has two 3.6 inch diameter phenolic plastic pistons with adjustable stroke to three inches. The pistons are sealed in stainless steel cylinders by lubricated O-rings. The two pistons are operated in parallel with the high pressure helium supplies splitting just before the engines and coming together just after the engines.

The portion of the medium pressure gas not directed to the turboexpander T3 is returned through line 40 in heat exchange sections HX-1 through HX-4 to the compressor section. The compressor section 14 is a three stage compressor, including a first low pressure stage 42, a second intermediate stage 44, and a final high pressure stage 46. In this embodiment, each compression stage includes two oil-flooded screw compressors in parallel. Aftercoolers 48, 50 and 52 are provided after respective compressor stages to water cool the compressed helium to near ambient temperature. Oil separators and filters (not shown) are also provided to remove oil and other impurities from the helium gas.

If all gas flow through the turbine were directed to the low pressure line 30, the heat exchanger size and first stage compressor size would be excessive due to the high specific volume of helium at low pressure. To avoid such large system components, it is known to operate the expanders at high pressure and provide a medium pressure return from the expanders parallel to the low pressure return from the liquifying tank 24. Such systems also allow for the limited pressure ratios across turboexpanders.

With the present system, an additional stage of refrigeration is advantageously positioned to provide for both high efficiency expansion and high efficiency compression. Where, as in prior systems, only low pressure gas from the liquid tank 24 is directed to the first compressor stage, the throughput of that stage, and thus its power input, is very small relative to successive compressor stages. But for maximum efficiency in the compressor section, each compressor stage should have about the same power input. To make the power inputs to the several compressor stages more equal, in the present system helium gas is directed from the medium pressure line 40 through turboexpander T3 to the low pressure line 30. This increases the throughput of the first compressor stage and thus increases its power requirements for a given compression ratio. The result is more equalized power inputs to the several compressor stages.

The placement of the turboexpander between medium and low pressure lines also allows for very efficient refrigeration. For helium at a given temperature level, the work that an expander develops is greater at lower pressure levels. This is due to the fact that, for helium, the enthalpy difference is greater at low pressures. With the present system the third stage of refrigeration is placed between medium and low pressure lines in the system and thus results in most efficient refrigeration.

It should be noted from FIG. 2 that the work input to the first stage compressor is near to but not as high as the input to the second and third stages. With the volumetric flow through the first compressor stage within reasonable limits, the power input can be increased by increasing the compression ratio across that stage. That compression ratio is limited, however, by the maximum expansion ratio of the turbine T3. Thus, the specific design of FIG. 2 provides for volumetric flow in the low pressure line which is suitable for the first stage compressor hardware, and it equalizes power input to the compressor stages to the extent possible given the limited expansion ratio of the turboexpander.

While the invention has been particularly shown and described with reference to a preferred embodiment thereof, it will be understood by those skilled in the art that various changes in form and details may be made therein without departing from the spirit and scope of the invention as defined by the appended claims.

We claim:

1. In a liquefaction plant of the type in which gas in a high pressure line from a compressor section is precooled by gas in medium and low pressure lines and is liquified in a liquifying stage, some high pressure gas is expanded and returned to the compressor section through the medium pressure line, and gas from the liquifying stage is returned to the compressor section through the low pressure line, the improvement of:

an expander between the medium and low pressure lines for further cooling a portion of the medium pressure gas.

2. The improvement in a liquefaction plant as claimed in claim 1 wherein the expanders are turboexpanders.

3. The improvement in a liquefaction plant as claimed in claim 1 in which medium pressure gas is further cooled by heat exchange with low pressure gas before it is directed to the expander between the medium and low pressure lines.

4. A helium liquifying plant for continuously providing liquid helium comprising:

a heat exchanger for precooling a first stream of compressed helium gas through heat exchange with cooler, lower pressure gas;

a helium liquifying expansion element for expanding the precooled gas to form a cold mixture of helium liquid and low pressure gas;

a medium pressure gas expander for expanding and cooling a second stream of compressed gas to a medium pressure gas;

a low pressure gas expander for further expanding and cooling some of the medium pressure gas to a low pressure;

a first compressor stage for compressing the low pressure gas from the first stream of gas and the low pressure gas from the low pressure expander; and a second compressor stage for compressing the output of the first compressor stage and medium pressure gas from the medium pressure gas expander.

5. A helium liquifying plant as claimed in claim 4 wherein the expanders are turboexpanders.

6. A helium liquifying plant as claimed in claim 4 further including another expander in series with the medium pressure expander for expanding compressed helium gas and directing that expanded gas to the medium pressure expander.

7. A helium liquifying plant as claimed in claim 4 wherein the medium pressure gas directed to the low pressure expander is first further cooled by heat exchange with low pressure gas.

8. A helium liquefaction plant with a warm end compressor section, a precooling heat exchanger and expander section and a cold end liquifying section, the improvement of:

a compressor comprising first, second and third compressor stages;

the precooling section comprising first, second and third turboexpanders positioned in series between high and low pressure lines in the heat exchangers, with a portion of the output from the second stage directed through the heat exchanger toward the warm end and mixed with the output of the first compressor stage.

9. A helium liquefaction plant as claimed in claim 8 wherein the gas directed to the second and third turboexpanders is first cooled in intermediate pressure lines in the heat exchanger.

10. A method of refrigerating comprising the steps of:

precooling a first stream of compressed helium in a heat exchanger and expanding the precooled gas to form a cold mixture of helium liquid and low pressure gas;

cooling a second stream of compressed helium gas in two expansion engines in series to a medium pressure gas;

further cooling a portion of the second stream of gas in another expansion engine to a low pressure gas;

using medium pressure gas, the further cooled low pressure portion of the second stream and the low pressure gas from the first stream to precool the first stream of compressed helium gas in said heat exchanger;

compressing the low pressure gas from the first stream of gas and the low pressure portion of the second stream of gas in a first compressor stage; and compressing the output of the first compressor stage and medium pressure gas from the second stream in a second compressor stage.

* * * * *